US008171677B2

(12) United States Patent
Flint et al.

(10) Patent No.: US 8,171,677 B2
(45) Date of Patent: May 8, 2012

(54) INSERT FOR A WEEP HOLE OPENING IN A MASONRY WALL

(76) Inventors: John Noel Flint, West End (AU); Lynne Patricia Oldfield, West End (AU)

( * ) Notice: Subject to any disclaimer, the term of this patent is extended or adjusted under 35 U.S.C. 154(b) by 889 days.

(21) Appl. No.: 12/095,759

(22) PCT Filed: Jan. 5, 2007
(Under 37 CFR 1.47)

(86) PCT No.: PCT/AU2007/000004

§ 371 (c)(1),
(2), (4) Date: Jun. 2, 2008

(87) PCT Pub. No.: WO2007/092985

PCT Pub. Date: Aug. 23, 2007

(65) Prior Publication Data

US 2008/0276556 A1 Nov. 13, 2008

(30) Foreign Application Priority Data

Feb. 15, 2006 (AU) ..... 2006900749

(51) Int. Cl.

| | |
|---|---|
| ***E04H 9/16*** | (2006.01) |
| ***E02D 27/00*** | (2006.01) |
| ***E04D 13/00*** | (2006.01) |
| ***E04F 17/06*** | (2006.01) |
| ***E04F 17/00*** | (2006.01) |
| ***E06B 5/02*** | (2006.01) |
| ***E04B 1/70*** | (2006.01) |

(52) U.S. Cl. ..... 52/101; 52/95; 52/97; 52/302.1; 52/107

(58) Field of Classification Search ..... 52/302.1, 52/101, 302.3, 302.6, 95, 97, 310, 169.5, 52/107

See application file for complete search history.

(56) References Cited

U.S. PATENT DOCUMENTS 2,709,402 A * 5/1955 Malm ..... 454/271
3,257,929 A * 6/1966 Kortvely ..... 454/280

(Continued)

FOREIGN PATENT DOCUMENTS

AU 713335 B1 12/1999

(Continued)

*Primary Examiner* — Mark Wendell
(74) *Attorney, Agent, or Firm* — David A. Guerra

(57) ABSTRACT

An insert (1) for a weep hole opening in a masonry wall is disclosed. The insert (1) includes a hollow body (2) defining an air flow conduit (3) and including a first open end (4) and a second open end (5). A stainless steel mesh screen (6) extends across the conduit (3) near the first open end (4) and is adapted to prevent fire brands and sparks from passing through the body (2). A locating member, in the form of a grate (7), is hingedly connected to the body (2) adjacent the first open end (4). The screen (6) is located in a recess (8) in the rear of the grate (7) and friction between the screen (6) and the grate (7) retains the screen (6) in the recess (8). The grate (7) is formed from a material that substantially retains its spatial integrity when exposed to the heat flux profile generated by a typical forest fire, such that the grate (7) continues thereafter to locate the screen (6). The grate (7) also has a plurality of ventilation apertures (9) to allow air to pass through the air flow conduit (3). A mortar guard (10) releasably snap-lockingly engages the grate (7) to cover the ventilation apertures (9) to prevent mortar clogging the apertures (9) during rendering.

19 Claims, 3 Drawing Sheets

U.S. PATENT DOCUMENTS

| | | | | |
|---|---|---|---|---|
| 3,429,084 | A * | 2/1969 | Brewer | 52/101 |
| 4,102,093 | A * | 7/1978 | Harris | 52/101 |
| 5,203,795 | A * | 4/1993 | Balamut et al. | 52/302.1 |
| 5,274,968 | A * | 1/1994 | Pardo | 52/97 |
| 5,598,673 | A * | 2/1997 | Atkins | 52/302.1 |
| 5,718,086 | A * | 2/1998 | Dunn | 52/95 |
| 5,918,427 | A * | 7/1999 | VanderWerf | 52/100 |
| 6,023,892 | A * | 2/2000 | Sourlis | 52/169.5 |
| 6,044,594 | A * | 4/2000 | Desselle | 52/101 |
| 6,105,323 | A * | 8/2000 | Paulle | 52/302.1 |
| 6,176,048 | B1 * | 1/2001 | Berger | 52/101 |
| 6,360,493 | B1 | 3/2002 | Torres | |
| 6,474,031 | B2 * | 11/2002 | Phillips | 52/302.1 |
| 6,662,504 | B2 * | 12/2003 | Krogstad | 52/61 |
| 6,796,100 | B1 * | 9/2004 | Venezia | 52/741.1 |
| 7,128,643 | B2 * | 10/2006 | Beliveau et al. | 454/276 |
| 7,685,778 | B2 * | 3/2010 | Edell | 52/16 |
| 7,823,349 | B2 * | 11/2010 | Alexander | 52/302.1 |
| 7,877,946 | B1 * | 2/2011 | Stepanek | 52/302.3 |
| 2004/0058638 | A1 * | 3/2004 | Achen | 454/277 |
| 2005/0066599 | A1 * | 3/2005 | Kimble | 52/302.1 |
| 2009/0019793 | A1 * | 1/2009 | Huber, Jr. | 52/101 |

FOREIGN PATENT DOCUMENTS

| | | |
|---|---|---|
| WO | 88/08905 | 11/1988 |

* cited by examiner

INSERT FOR A WEEP HOLE OPENING IN A MASONRY WALL

CROSS-REFERENCE TO RELATED APPLICATIONS

This application is an U.S. national phase application under 35 U.S.C. §371 based upon co-pending International Application No. PCT/AU2007/000004 filed on Jan. 5, 2007. Additionally, this U.S. national phase application claims the benefit of priority of co-pending International Application No. PCT/AU2007/000004 filed on Jan. 5, 2007 and Australia Application No. 2006900749 filed on Feb. 15, 2006. The entire disclosures of the prior applications are incorporated herein by reference. The international application was published on Aug. 23, 2007 under Publication No. WO 2007/092985.

TECHNICAL FIELD

The present invention relates to an insert for a weep hole opening in a masonry wall and will be described hereinafter with reference to this application. However, the invention is not limited to this application and may also be used in underfloor vents, retaining walls and tilt-up concrete walls.

BACKGROUND OF THE INVENTION

In cavity brick or block masonry construction, weep hole openings are left in mortar joints just above the flashing to allow both ventilation and drainage of the wall cavity between the exterior masonry and the interior wall. A weep hole opening is typically formed by the omission of mortar between two adjacent bricks or blocks. The weep hole opening provides ventilation and drainage to keep the wall cavity dry. Without adequate ventilation, dampness causes mildew and rot, which reduce the life of the structure.

Weephole openings vary considerably in size and shape dependent on the skill and care of the tradesmen and the type of brick and type of finishes being applied. A problem with weep hole openings situated close to ground level, as are common, is that they can become an entry for rodents and reptiles. Similarly, a problem with weep hole openings around windows or second floors is that they can provide an entry for insects. In particular, the weep hole opening leading to the wall cavity is an ideal home for bees, wasps and other insects, which themselves create food sources for other pests. Another problem associated with weep hole openings is that they provide an entry point for water, particularly during excessive rain or from garden sprinklers. Another problem with weep hole openings is that they can allow sparks and firebrands to penetrate a building.

There have been a number of known approaches which attempt to solve some of the above problems.

U.S. Pat. No. 4,282,691 (Risdon) discloses a weep hole device utilising a wick, tube and screen cap. U.S. Pat. No. 4,587,891 (Kruse) discloses a ventilating device that incorporates a tubular member and a screened bottom. UK Patent No. 2231889A (Knox) discloses a filter system for allowing drainage from trays in cavity wall.

U.S. Pat. No. 2,709,402 (Mahn) discloses a wall mounted ventilator using a series of parallel prongs as a fixing means. Australian Design Registration 131293 appears to disclose a similar device. U.S. Pat. No. 5,203,795 (Balamut et al) discloses a perforated wall plate and sealing gasket with an anchoring device.

U.S. Pat. No. 4,102,093 (Harris) discloses forcing a perforated sheet of aluminium into the weep hole opening and then using a special tool to deform the sheet to the shape of the opening.

The present applicants' earlier Australian Patent No. 713335, the entire disclosure of which is incorporated herein by reference, discloses a weep hole device including a hollow plastic body for engagement in a weep hole opening. A removable cover is provided over one end of the body to prevent mortar clogging the body during rendering. The cover is removed after rendering is complete and a vermin-proof grate is fitted onto the end of the body in its place. However, a problem with this device is that the grate cannot be installed until after rendering is complete and it is common for tradesmen to misplace the grate.

A problem with known weep hole devices, such as those mentioned above, is that they often fail as a result of being exposed to high temperatures, for example during bushfires. The failure can occur as a result of the weep hole device igniting and disintegrating, or due to the device melting, which allows fire brands and sparks, as well as vermin and insects, to enter the wall cavity.

Another problem with known weep hole devices is that they do not allow easy access to, or inspection of, the wall cavity.

OBJECT OF THE INVENTION

It is the object of the present invention, at least in its preferred form, to substantially overcome or at least ameliorate one or more of the above disadvantages.

SUMMARY OF THE INVENTION

Accordingly, in a first aspect, the invention provides an insert for a weep hole opening in a masonry wall, said weep hole insert comprising:

- a hollow body defining an air flow conduit and including first and second open ends;
- a screen extending across the conduit near the first open end and adapted to prevent fire brands and sparks from passing through the body; and
- a locating member for locating the screen in the conduit, the locating member being connected to the body adjacent the first open end and formed from a material that substantially retains its spatial integrity when exposed to a predetermined heat flux profile and continues thereafter to locate the screen.

More preferably, the predetermined heat flux profile is typical of that generated by a forest fire.

Preferably, the locating member is adapted to insulate the screen from radiant heat.

The locating member is preferably formed from a polymer. More preferably, the polymer is a halogen containing polymer. In a preferred form, the locating member is formed from polyvinylchloride. Preferably, the material forming the locating member is also self-extinguishing.

Preferably, the locating member is a grate having a plurality of ventilation apertures to allow air to pass through the air flow conduit. More preferably, the grate is hingedly connected to the body and movable between a closed position for preventing vermin and/or insects from passing through the body and an open position for allowing inspection for the interior of the body. The body preferably includes an abutment surface engageable by the grate for holding the grate in the open position. In a preferred form, the grate includes a recess for locating the screen. Preferably, friction between the screen and the grate retains the screen in the recess.

Preferably, the screen is removable. More preferably, the screen is a mesh including cells of less than around 2 mm×2 mm. Even more preferably, the cells are around 0.45 mm×0.45 mm. In a preferred form, the screen is formed from a heat conductive material. Preferably, the screen is metal and more preferably is stainless steel.

In a second aspect, the invention provides an insert for a weep hole opening in a masonry wall, said weep hole insert comprising:

- a hollow body defining an air flow conduit and including first and second open ends; and
- a grate hingedly connected to the hollow body adjacent the first open end and movable between a closed position for preventing vermin and/or insects from passing through the body and an open position for allowing inspection for the interior of the body, the grate including a plurality of ventilation apertures to allow air to pass through the air flow conduit.

The body preferably includes an abutment surface engageable by the grate for holding the grate in the open position.

Preferably, the weep hole insert also includes a removable screen extending across the conduit, inwardly of the grate, and adapted to prevent fire brands and sparks from passing through the body. More preferably, the screen is a mesh including cells of less than around 2 mm×2 mm. Even more preferably, the cells are around 0.45 mm×0.45 mm. In a preferred form, the screen is formed from a heat conductive material. Preferably, the screen is formed from metal and more preferably from stainless steel. The screen is preferably located in a recess in the grate. More preferably, friction between the screen and the grate retains the screen in the recess.

In a preferred form, the grate is formed from a material that substantially retains its spatial integrity when exposed to a predetermined heat flux profile and continues thereafter to locate the screen. More preferably, the grate is adapted to insulate the screen from radiant heat. Even more preferably, the predetermined heat flux profile is typical of that generated by a forest fire.

Preferably, the grate is formed from a polymer. More preferably, the polymer is a halogen containing polymer. In a preferred form, the grate is formed from polyvinylchloride. Preferably also, the material forming the grate is self-extinguishing. In a third aspect, the invention provides an insert for a weep hole opening in a masonry wall, said weep hole insert comprising:

- a hollow body defining an air flow conduit and including first and second open ends; and
- a grate connected to the hollow body adjacent the first open end for preventing vermin and/or insects from passing through the body, the grate including a plurality of ventilation apertures to allow air to pass through the air flow conduit; and
- a mortar guard releasably engageable with the grate to cover the ventilation apertures during rendering.

Preferably, the weep hole insert also includes a removable screen extending across the conduit, inwardly of the grate, and adapted to prevent fire brands and sparks from passing through the body. More preferably, the screen is a mesh including cells of less than around 2 mm×2 mm. Even more preferably, the cells are around 0.45 mm×0.45 mm. In a preferred form, the screen is formed from a heat conductive material. Preferably, the screen is formed from metal and more preferably from stainless steel. The screen is preferably located in a recess in the grate. More preferably, friction between the screen and the grate retains the screen in the recess.

Preferably, the grate is hingedly connected to the body and movable between a closed position for preventing vermin and/or insects from passing through the body and an open position for allowing inspection for the interior of the body. The body preferably includes an abutment surface engageable by the grate for holding the grate in the open position.

In a preferred form, the grate is formed from a material that substantially retains its spatial integrity when exposed to a predetermined heat flux profile and continues thereafter to locate the screen. More preferably, the grate is adapted to insulate the screen from radiant heat. Preferably also, the predetermined heat flux profile is typical of that generated by a forest fire.

Preferably, the grate is formed from a polymer. More preferably, the polymer is a halogen containing polymer. In a preferred form, the grate is formed from polyvinylchloride. Preferably also, the material forming the grate is self-extinguishing.

BRIEF DESCRIPTION OF THE DRAWINGS

A preferred form of the present invention will now be described, by way of an example only, with reference to the accompanying drawings, wherein.

DETAILED DESCRIPTION OF THE PREFERRED EMBODIMENT

Figure 1:
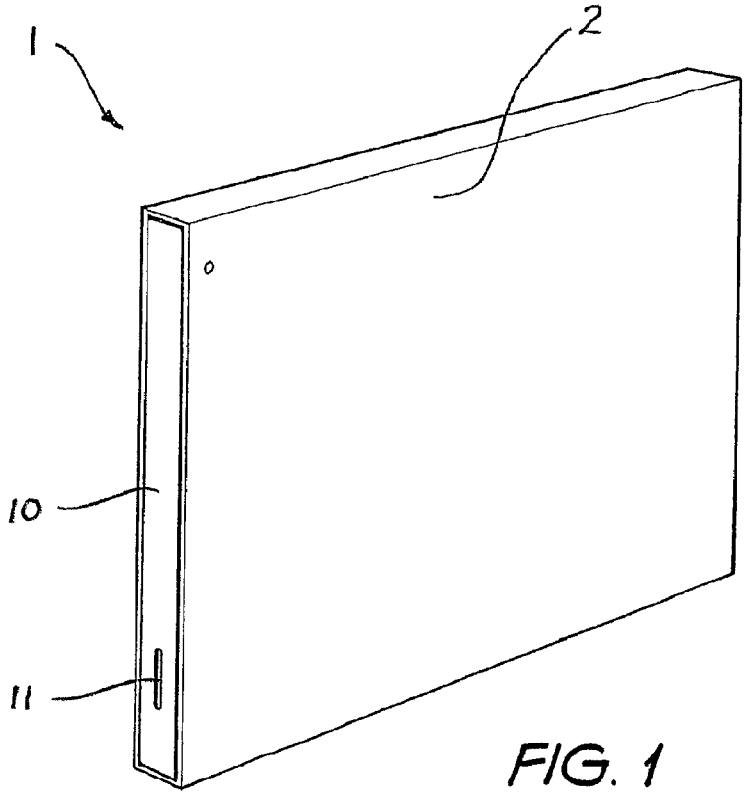
FIG. 1 is a perspective view of a preferred embodiment of an insert for a weep hole opening according to the invention, showing the grate in a closed position and with the mortar guard in place.

Referring to FIGS. 1 to 4 of the drawings, there is shown an insert 1 for a weep hole opening in a masonry wall. The insert 1 includes a hollow body 2 defining an air flow conduit 3 and including a first open end 4 and a second open end 5. A stainless steel mesh screen 6 extends across the conduit 3 near the first open end 4 and is adapted to prevent fire brands and sparks from passing through the body 2 and to absorb heat from the fire brands and sparks. The screen 6 includes cells of about 0.45 mm×0.45 mm. A locating member, in the form of a grate 7, is hingedly connected to the body 2 adjacent the first open end 4. The screen 6 is located in a recess 8 in the rear of the grate 7 and friction between the screen 6 and the grate 7 retains the screen 6 in the recess 8. The grate 7 is formed from a material that substantially retains its spatial integrity when exposed to the heat flux profile generated by a typical forest fire, such that the grate 7 continues thereafter to locate the screen 6. The grate 7 also has a plurality of ventilation apertures 9 to allow air to pass through the air flow conduit 3.

Figure 5:
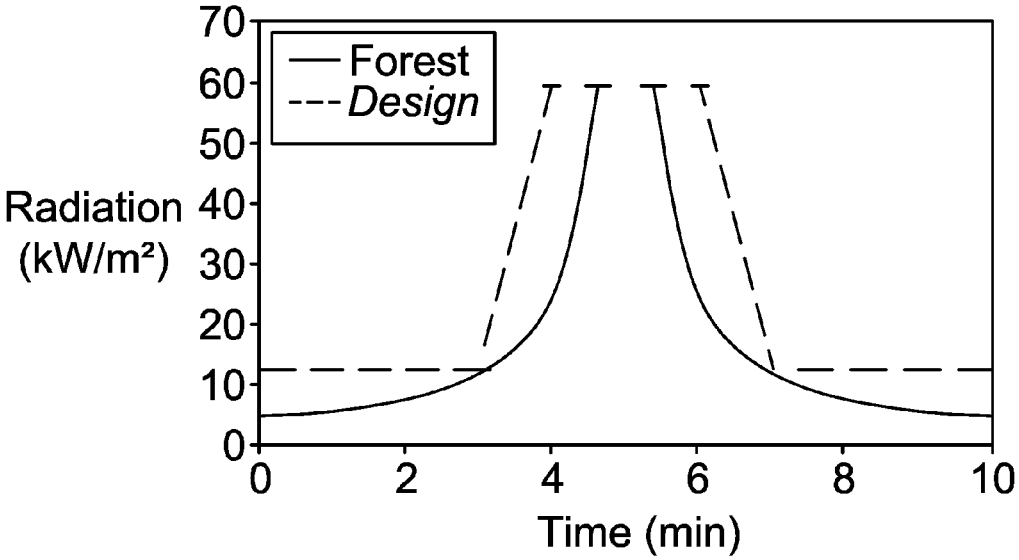
FIG. 5 is a graph of the heat flux profiles for a forest fire and a design fire.

FIG. 5 shows the heat flux profile generated by a typical forest fire. This figure also shows a design heat flux profile based on the typical forest fire profile. To withstand exposure to the design heat flux profile, the grate 7 is moulded from polyvinylchloride, which is self-extinguishing and flame retardant. This material tends to burn and char when exposed to the design heat flux profile shown in FIG. 5, and quickly self-extinguishes once a fire has passed. In alternative embodiments, other polymers with flame-retardant characteristics are used, such as other halogen containing polymers or cross-linked polymers.

Figure 2:
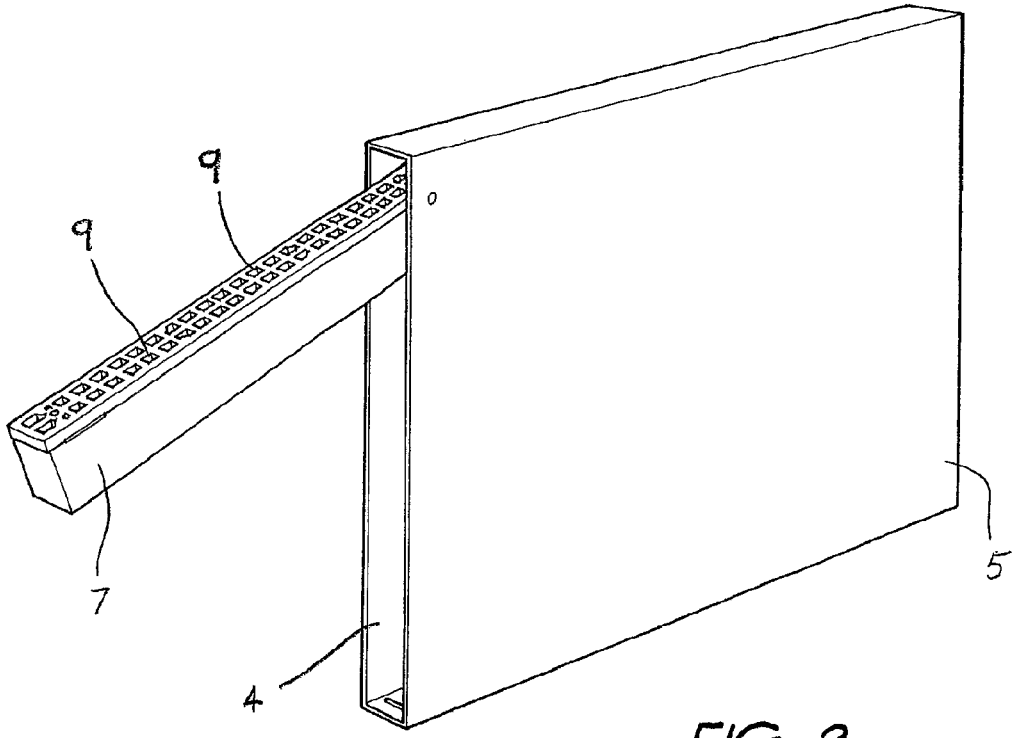
FIG. 2 is a perspective view of the weep hole insert of FIG. 1, showing the grate in an open position.
Figure 3:
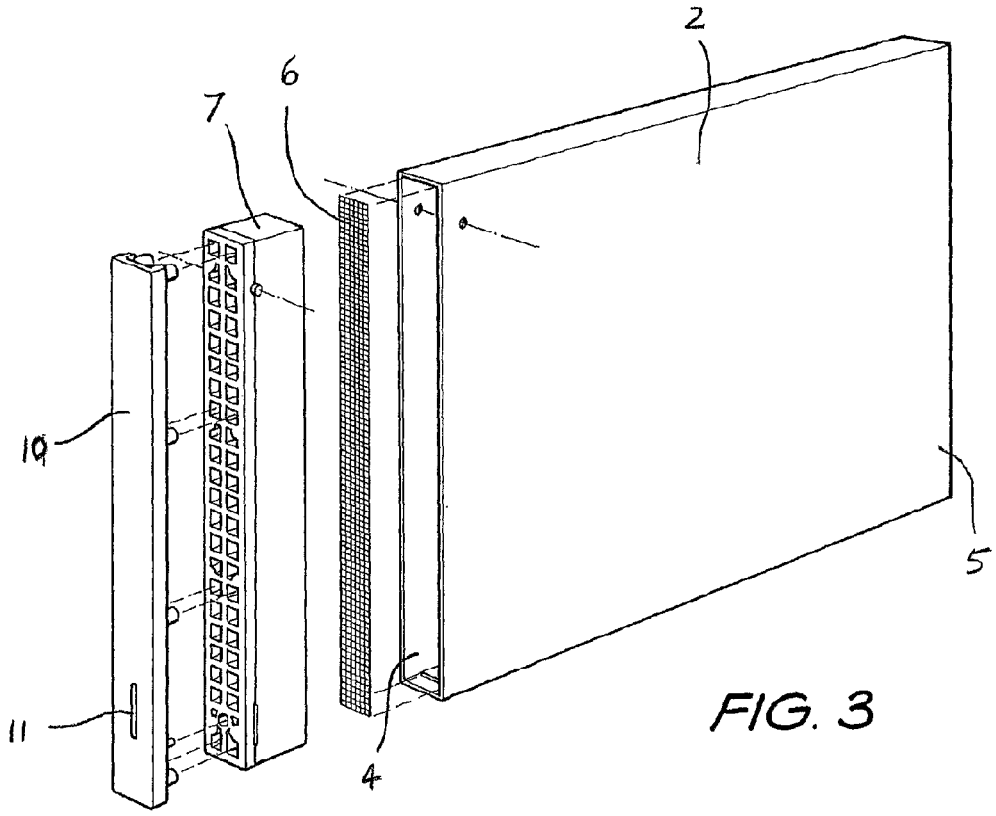
FIG. 3 is an exploded perspective view of the weep hole insert of FIG. 1.
Figure 4:
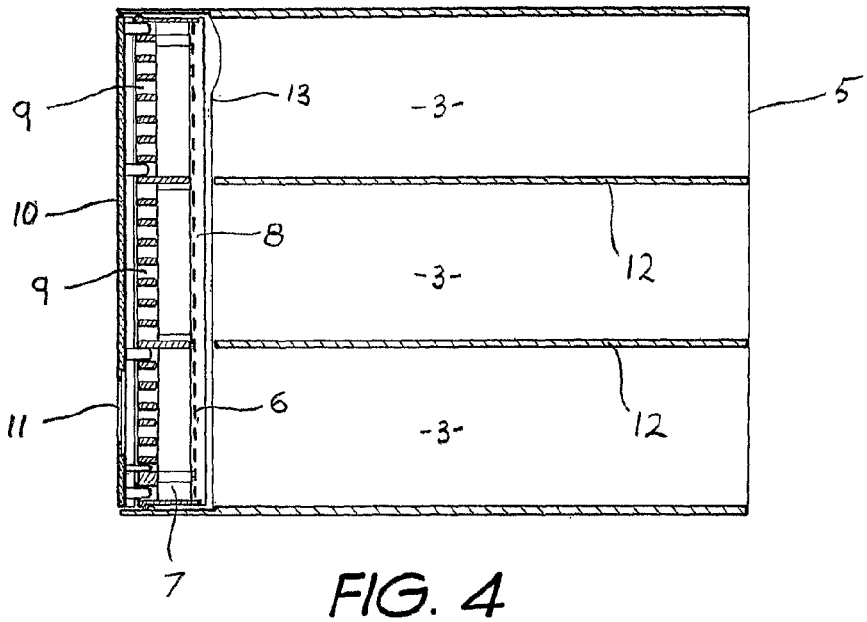
FIG. 4 is a longitudinal cross-sectional view through the weep hole insert of FIG. 1.

The grate 7 is hingedly connected to the body 2 and movable between a closed position for preventing vermin and/or insects from passing through the body 2 and an open position for allowing inspection for the interior of the body 2. When the grate 7 is in the open position, as illustrated in FIG. 2, it also permits access to the wall cavity for the placement of insecticides or other treatments. When the grate 7 is in a closed position, as illustrated in FIGS. 1 and 4, the screen 6 is located inwardly of the grate 7 such that the grate 7 insulates the screen 6 from radiant heat outside the grate. Also, in the closed position, the grate 7 is recessed with respect to the first open end 4 of the body 2.

A mortar guard 10 releasably snap-lockingly engages the grate 7 to cover the ventilation apertures 9 to prevent mortar clogging the apertures 9 during rendering. However, due to the grate 7 being recessed, the outer surface of the mortar guard 10 is flush with the first open end 4 of the body 2. The mortar guard includes a slot 11 engageable by a screwdriver or the like to facilitate its removal from the grate 7, when rendering is complete.

The body 2 is sized for a snug fit within a weep hole opening of a masonry wall. The body 2 includes substantially planar outer surfaces to facilitate adjustment of the position of the weep hole insert 1 within the weep hole opening. Also, the omission of anchors makes it easy to remove and replace the insert 1 if it becomes unserviceable. The body 2 includes internal ribs 12 for strengthening its sidewalls against bowing. Also, the body 2 includes an abutment surface 13 engageable by the grate 7 for holding the grate 7 in the open position.

The mesh screen 6 and the mortar guard 9 are pre-installed in the weep hole insert 1. In use, the weep hole insert 1 is placed into the weep hole opening of a wall with the first end 4 directed toward the exterior of the wall and the second end 5 directed toward the wall cavity. The grate 7 can be opened to allow the internal ribs 12 to be gripped by long nosed pliers to assist in accurate placement of the weep hole insert 1. Once the insert 1 has been accurately placed, the grate 7 is closed. After rendering is completed, the mortar guard 10 is removed from the grate 7 to expose the ventilation apertures 9.

It will be appreciated that the illustrated weep hole insert 1 is well adapted for use in bushfire prone areas. The weep hole insert 1 also facilitates access to the wall cavity for inspections and the placement of insecticides and other treatments. The unitary construction of the illustrated insert 1 also overcomes the prior art problem of tradesmen losing the grate. Also, the planar outer surface profile of the insert 1 makes it is easy for tradesman to adjust the position of the insert 1 in the weep hole opening and also facilitates removal of damaged weep hole inserts.

While the invention has been described with reference to a specific embodiment, it will be appreciated that it may also be embodied in many other forms.

The invention claimed is:

1. An insert for a weep hole opening in a masonry wall, said weep hole insert comprising:

a hollow body defining an air flow conduit and including first and second open ends;

a screen located in said air flow conduit near said first open end and adapted to prevent fire brands and sparks from passing through said hollow body; and a locating member for locating said screen in said air flow conduit, said locating member being receivable in said first open end of said hollow body and formed from a material that substantially retains its spatial integrity when exposed to a predetermined heat flux profile and continues thereafter to locate said screen;

wherein said locating member further comprising a recess for locating said screen, friction between said screen and said locating member removably retains said screen in said recess;

wherein said locating member being hingedly connected to said hollow body adjacent said first open end, said locating member being movable between a closed position for preventing vermin and/or insects from passing through said hollow body and an open position for allowing inspection of an interior of said hollow body.

2. The insert according to claim 1, wherein said locating member is adapted to insulate said screen from radiant heat.

3. The insert according to claim 2, wherein said locating member is formed from a material selected from the group consisting of a polymer, a halogen containing polymer, and polyvinylchloride.

4. The insert according to claim 1, wherein said locating member is a grate defining a plurality of ventilation apertures to allow air to pass through said air flow conduit.

5. The insert according to claim 4, wherein said hollow body further comprising an abutment surface engageable by said grate for holding said grate in said open position.

6. The insert according to claim 5, wherein said abutment surface further comprising a first section defined into an interior of said hollow body and a second section defined into said interior of said hollow body a distance greater than said first section, said second section configured to receive an end of said grate when in said open position.

7. The insert according to claim 1, wherein said screen is a mesh including cells of less than substantially 2 mm×2 mm, and said screen is formed from a heat conductive material.

8. The insert according to claim 1, wherein said air flow conduit of said hollow body further comprising at least one internal rib located in said air flow conduit and between sidewalls of said hollow body.

9. The insert according to claim 1 further comprising a mortar guard releasably engageable to said locating member, said mortar guard being snap-lockingly engageable to said locating member.

10. The insert according to claim 1, wherein the predetermined heat flux profile includes a peak heat flux of between substantially 30 $kW/m^2$ and substantially 90 $kW/m^2$, a lead-in heat flux of between substantially 5 $kW/m^2$ and substantially 20 $kW/m^2$, and a lead-out heat flux of between substantially 5 $kW/m^2$ and substantially 20 $kW/m^2$.

11. The insert according to claim 10, wherein said peak heat flux is applied for a duration of up to substantially 5 min, said lead-in heat flux is applied for a duration between substantially 2 and substantially 4 min, and said lead-out heat flux is applied for a duration between substantially 2 and substantially 4 min.

12. A weep hole opening insert comprising:

a hollow body defining an air flow conduit and including first and second open ends;

a screen extending across said air flow conduit near said first open end and adapted to prevent fire brands and sparks from passing through said hollow body;

a grate received in said first open end of said hollow body for preventing vermin and/or insects from passing through said hollow body, said grate defining a plurality of ventilation apertures to allow air to pass through said air flow conduit, said grate being adapted to insulate said screen from radiant heat; and a mortar guard releasably engageable with said grate to cover said ventilation apertures during rendering;

wherein said grate is formed from a material that substantially retains its spatial integrity when exposed to a predetermined heat flux profile and continues thereafter to locate said screen.

13. The insert according to claim 12, wherein said grate is formed from a material selected from the group consisting of a polymer, a halogen containing polymer, polyvinylchloride, and a self-extinguishing material.

14. The insert according to claim 12, wherein said grate is hingedly connectable to said hollow body adjacent said first open end, said grate being movable between a closed position for preventing vermin and/or insects from passing through said hollow body and an open position for allowing inspection for the interior of said hollow body.

15. The insert according to claim 12, wherein said hollow body further comprising an abutment surface engageable by said grate for holding said grate in an open position, said abutment surface further comprising a first section defined into said hollow body and a second section defined into said hollow body a distance greater than said first section, said second section configured to receive an end of said grate when in said open position.

16. The insert according to claim 15, wherein said grate further comprising a recess for locating said screen and friction between said screen and said grate removably retains said screen in said recess.

17. The insert according to claim 16, wherein said screen is a mesh including cells of less than substantially 0.45 mm×0.45 mm, and said screen is formed from a heat conductive material.

18. The insert according to claim 12, wherein said air flow conduit of said hollow body further comprising at least one internal rib located in said air flow conduit and between sidewalls of said hollow body.

19. A weep hole opening insert comprising:

a hollow body defining an air flow conduit and including first and second open ends;

a screen extending across said air flow conduit near said first open end and adapted to prevent fire brands and sparks from passing through said hollow body;

a grate hingedly connectable to said hollow body adjacent said first open end, said grate being movable between a closed position for preventing vermin and/or insects from passing through said hollow body and an open position for allowing inspection for the interior of said hollow body, said grate defining a plurality of ventilation apertures to allow air to pass through said air flow conduit, said grate being adapted to insulate said screen from radiant heat; and a mortar guard releasably engageable with said grate to cover said ventilation apertures during rendering;

wherein said grate is formed from a material that substantially retains its spatial integrity when exposed to a predetermined heat flux profile and continues thereafter to locate said screen;

wherein said hollow body further comprising an abutment surface engageable by said grate for holding said grate in said open position, said abutment surface further comprising a first section defined into said hollow body and a second section defined into said hollow body a distance greater than said first section, said second section configured to receive an end of said grate when in said open position;

wherein said grate further comprising a recess for locating said screen and friction between said screen and said grate removable retains said screen in said recess.

* * * * *